US010658795B2

(12) United States Patent
Hsiao et al.

(10) Patent No.: US 10,658,795 B2
(45) Date of Patent: May 19, 2020

(54) CABLE ASSEMBLY

(71) Applicant: BizLink International Corp., New Taipei (TW)

(72) Inventors: Hsin-Tuan Hsiao, New Taipei (TW); Kuo-Yang Tsai, New Taipei (TW)

(73) Assignee: BizLink International Corp., New Taipei (TW)

( * ) Notice: Subject to any disclaimer, the term of this patent is extended or adjusted under 35 U.S.C. 154(b) by 0 days.

(21) Appl. No.: 16/372,428

(22) Filed: Apr. 2, 2019

(65) Prior Publication Data

US 2020/0127418 A1 Apr. 23, 2020

(30) Foreign Application Priority Data

Oct. 19, 2018 (TW) ..... 107137064 A

(51) Int. Cl.
*H01R 13/646* (2011.01)
*H01R 13/502* (2006.01)
*H01R 12/71* (2011.01)

(52) U.S. Cl.
CPC ..... *H01R 13/646* (2013.01); *H01R 12/714* (2013.01); *H01R 13/502* (2013.01)

(58) Field of Classification Search
CPC ..... H01R 13/502; H01R 13/646; H01R 13/6471; H01R 13/71
See application file for complete search history.

(56) References Cited

U.S. PATENT DOCUMENTS 6,746,255 B1 * 6/2004 Lee ..... H01R 13/504 439/108
6,843,683 B2 * 1/2005 Cheng ..... H01R 13/405 439/606
2009/0130888 A1 * 5/2009 Ko ..... H01R 12/592 439/329
2010/0167568 A1 * 7/2010 Kondo ..... H01R 24/62 439/259
2013/0196550 A1 * 8/2013 Casher ..... H01R 12/724 439/660
2016/0312919 A1 10/2016 Gutgold et al.
2017/0302030 A1 * 10/2017 Chiang ..... H01R 24/62
2019/0097357 A1 * 3/2019 Mongold ..... H01R 12/724
2019/0372274 A1 * 12/2019 Feng ..... H01R 12/732

FOREIGN PATENT DOCUMENTS

TW M468066 U 12/2013

* cited by examiner

*Primary Examiner* — Oscar C Jimenez
(74) *Attorney, Agent, or Firm* — CKC & Partners Co., LLC

(57) ABSTRACT

A cable assembly includes a plurality of wires and a plurality of electrical contacts. The electrical contacts include contact sections and wire connection sections, and the wire connection sections of the electrical contacts are respectively connected to the wires. Two adjacent electrical contacts for transmitting signals have a first center distance and a reduced center distance. The first center distance is adjacent to the contact sections, and the reduced center distance is between the first center distance and the wire connecting sections. In addition, the first center distance is greater than the reduced center distance to improve signal integrity.

6 Claims, 3 Drawing Sheets

CABLE ASSEMBLY

RELATED APPLICATIONS

This application claims priority to Taiwan Application Serial Number 107137064, filed Oct. 19, 2018, which is herein incorporated by reference.

TECHNICAL FIELD

The present disclosure generally relates to a cable assembly. More particularly, the present disclosure relates to a high frequency cable assembly.

BACKGROUND

With the development and innovation of various high frequency electronic products, new high frequency electronic products require relatively more bandwidth. Therefore, the world today relies on the rapid and reliable information transmission.

As semiconductors continue to break through in technology, the semiconductors have been widely used in the computer bus architecture, network infrastructure, and digital wireless communication. In the computer industry, especially when the speed of the server computer processor has been upgraded to gigahertz (GHz), the memory transmission rate and the internal bus speed are also apparently increased. High-speed data transmission technology can support more powerful computer applications such as 3D games and computer-aided design programs. Advanced 3D images require a large amount of data transmission in the CPU, memory, and display card.

However, computer technology is only one part of the new information and bandwidth era. Digital communication engineers are also gradually adopting higher frequency data transmission technology in the new communication products. At the same time, in the field of digital high-definition video technology, the next generation of high-quality, interactive video equipment is being designed. Various new technologies continue to improve data transmission rates. Emerging serial bus is breaking the bottleneck of parallel bus architectures.

The increasing bandwidth is a challenge for digital system design. In the past, data interactions occurred in milliseconds, but now data interactions are measured in nanoseconds. Therefore, there is a need to more accurately transmit the required signals for an electronic cable at a higher data transmission rate.

SUMMARY

One objective of the embodiments of the present invention is to provide a cable assembly to improve the high frequency signal integrity and further increase the quality and speed of high frequency signal transmission.

To achieve these and other advantages and in accordance with the objective of the embodiments of the present invention, as the embodiment broadly describes herein, the embodiments of the present invention provides an cable assembly including a plurality of wires and a plurality of electrical contacts. The electrical contacts include contact sections, fixing sections and wire connection sections, the wire connection sections of the electrical contacts respectively connect to the wires. Two adjacent electrical contacts of the electrical contacts include a first center distance and a reduced center distance, the first center distance is adjacent to the contact sections and the reduced center distance is located between the first center distance and the wire connection sections, and the first center distance is larger than the reduced center distance to improve a signal integrity for the cable assembly.

The cable assembly further includes a fixation device to fix the electrical contacts. In some embodiments, the electrical contacts are held and fixed by the fixation device through a plastic insert molding process.

In some embodiments, the reduced center distance is a second center distance located between the fixing sections and the first center distance.

In some embodiments, the reduced center distance is a third center distance located at the fixing sections.

In some embodiments, the reduced center distance comprises a second center distance located between the fixing sections and the first center distance, and a third center distance located at the fixing sections.

In some embodiments, the two adjacent electrical contacts further include a fourth center distance located at the wire connection sections and the first center distance is equal to the fourth center distance.

In some embodiments, the two adjacent electrical contacts are a pair of signal transmission electrical contacts.

In some embodiments, the cable assembly further includes a protecting cover. The fixation device fixes the electrical contacts in the protecting cover, and the protecting cover includes a protecting lid and a U-shaped sidewall formed on one side of the protecting lid.

In some embodiments, the protecting cover is a plastic protecting cover and the fixation device is a plastic fixation device.

Hence, the cable assembly can be conveniently coupled to the print circuit board to directly connect to the pads on the print circuit board. In addition, because that the shape of the electrical contacts are changed to improve the signal integrity, the signal integrity of the high frequency signal can be effectively improved more effectively, and furthermore the quality and speed of the high frequency signal transmission are also effectively increased.

BRIEF DESCRIPTION OF THE DRAWINGS

The foregoing aspects and many of the attendant advantages of this invention will be more readily appreciated as the same becomes better understood by reference to the following detailed description, when taken in conjunction with the accompanying drawings, wherein.

DETAILED DESCRIPTION OF THE PREFERRED EMBODIMENT

The following description is of the best presently contemplated mode of carrying out the present disclosure. This description is not to be taken in a limiting sense but is made merely for the purpose of describing the general principles of the invention. The scope of the invention should be determined by referencing the appended claims.

Figure 1:
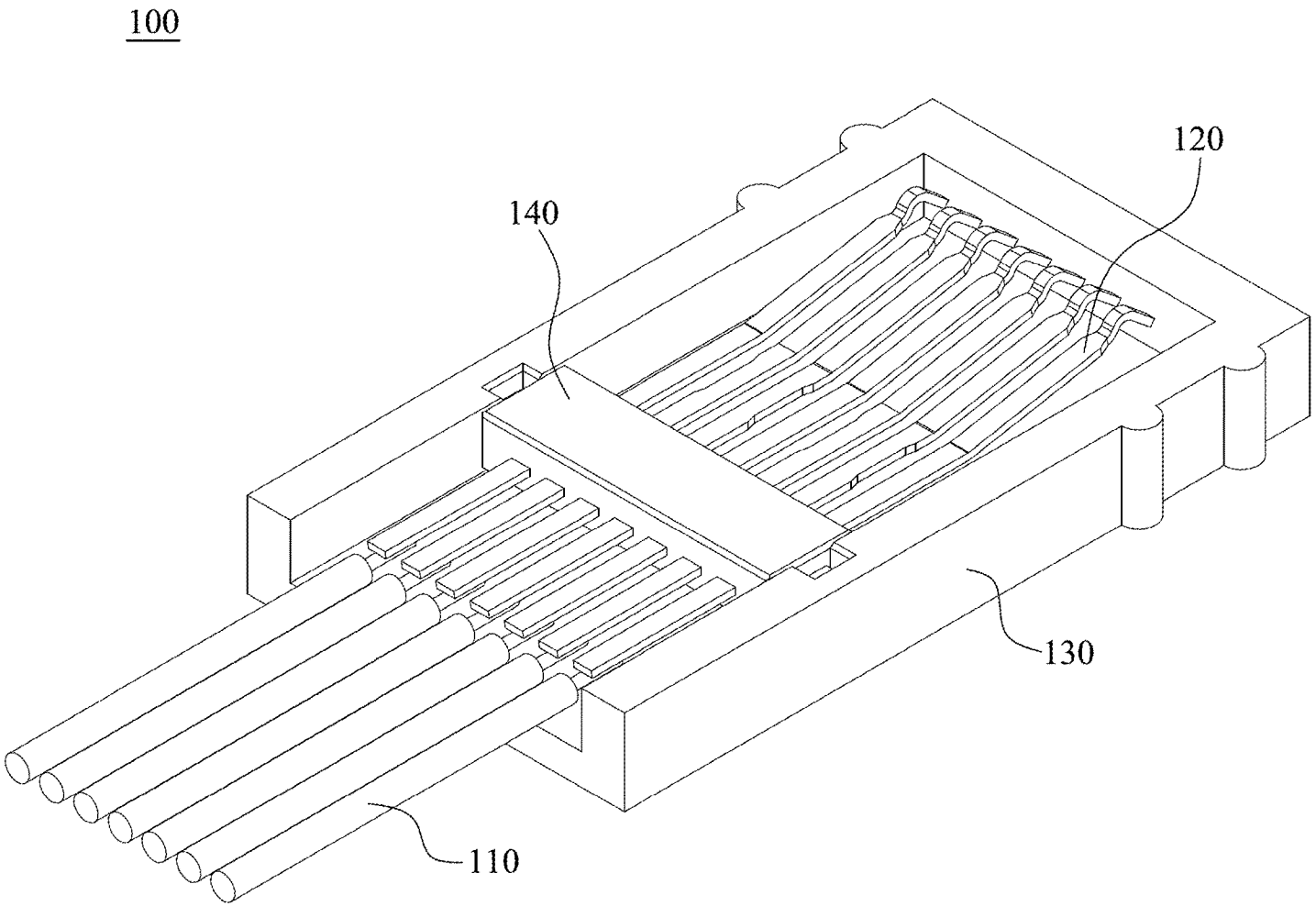
FIG. 1 illustrates a schematic perspective diagram showing a cable assembly according to one embodiment of the present invention.
Figure 2:
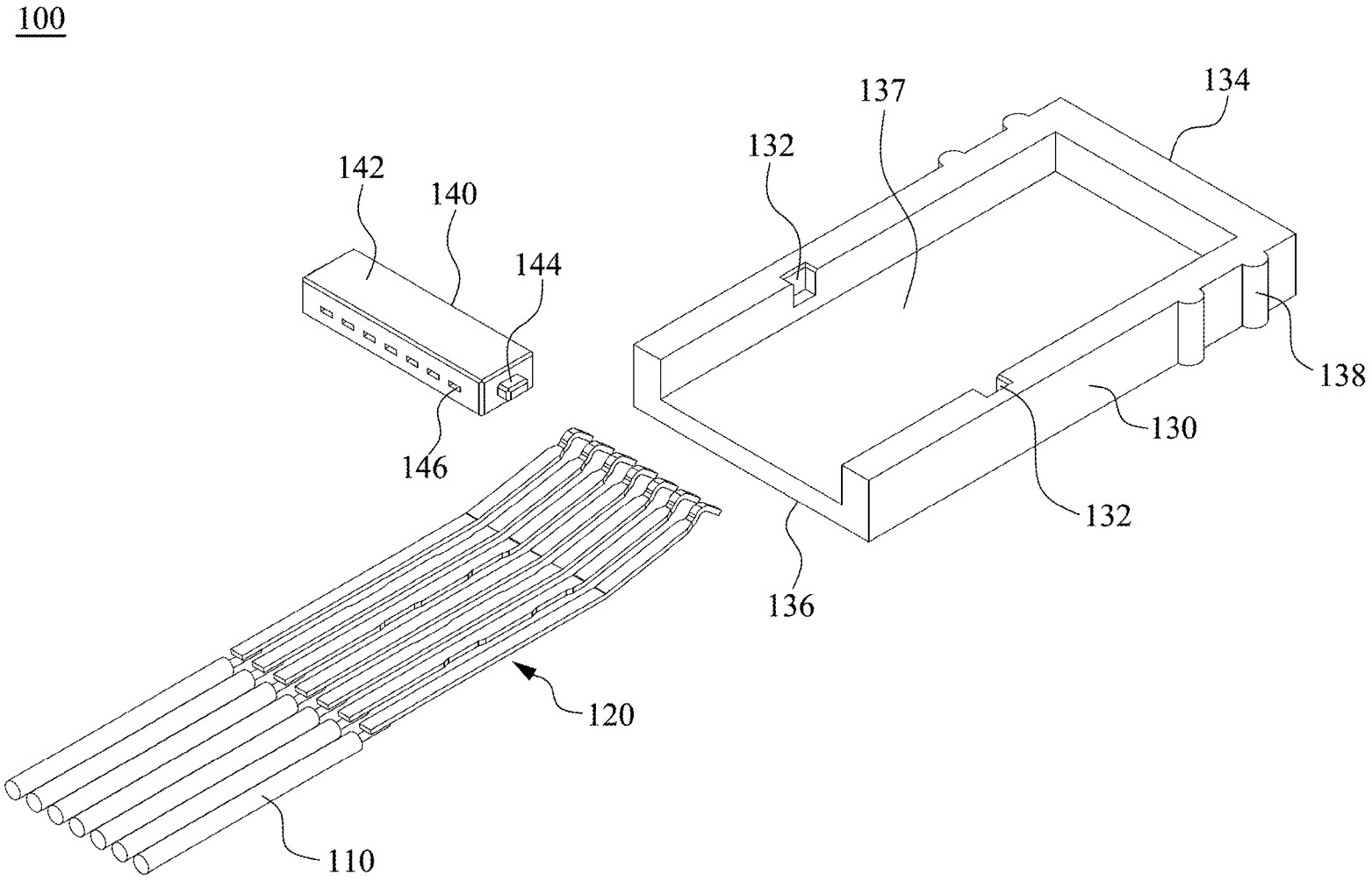
FIG. 2 illustrates a schematic exploded view showing a cable assembly according to one embodiment of the present invention.
Figure 3:
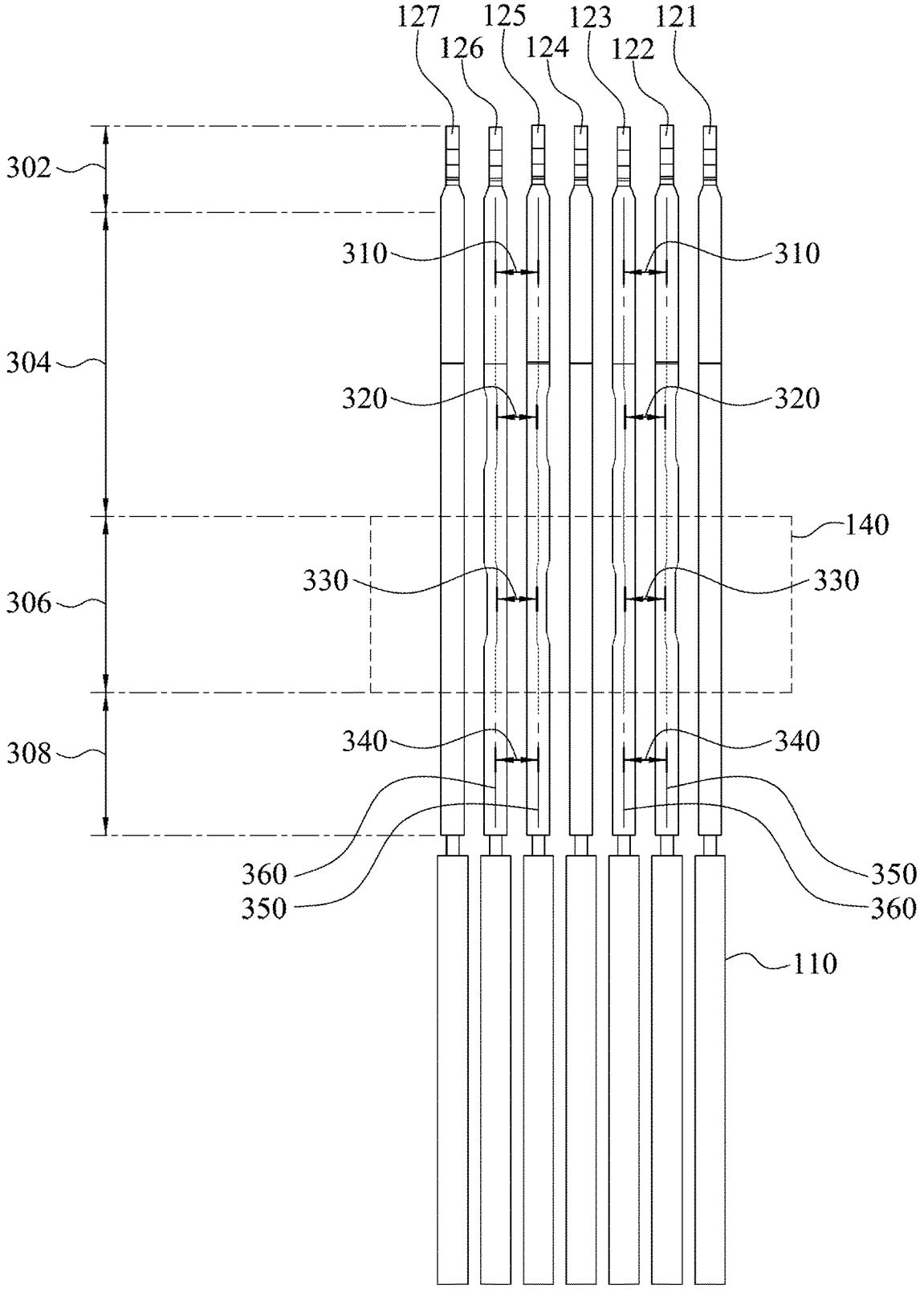
FIG. 3 illustrates a schematic front view showing electrical contacts of a cable assembly according to one embodiment of the present invention.

Refer to FIGS. 1-3. FIG. 1 illustrates a schematic perspective diagram showing a cable assembly according to one embodiment of the present invention, FIG. 2 illustrates a schematic exploded view thereof, and FIG. 3 illustrates a schematic front view of electrical contacts thereof.

As shown in FIG. 1, a cable assembly 100 includes a plurality of wires 110, a plurality of electrical contacts 120, a protecting cover 130 and a fixation device 140.

The wires 110 are respectively fixed to the electrical contacts 120, the electrical contacts 120 are fixed by the fixation device 140, and the fixation device 140, the wires 110 and the electrical contacts 120 are installed in the protecting cover 130.

Simultaneously referring to FIG. 3, the electrical contacts 120 have contact sections 302, exposing sections 304, fixing sections 306 and wire connection sections 308 in sequence. The contact sections 302 of the electrical contacts 120 are configured to electrically connect to pads, e.g. golden fingers, of a print circuit board, e.g. a mother board.

The wire connection sections 308 of the electrical contacts 120 are electrically connected to the wires 110 by, for example, welding or the like.

The electrical contact 120 includes, for example, a first ground electrical contact 121, a first signal electrical contact 122, a second signal electrical contact 123, a second ground electrical contact 124, a third signal electrical contact 125, a fourth signal electrical contact 126 and a third ground electrical contact 127. The first signal electrical contact 122 and the second signal electrical contact 123 are configured to form a pair of signal transmission electrical contacts, the third signal electrical contact 125 and the fourth signal electrical contact 126 are configured to form another pair of signal transmission electrical contacts.

When a conventional cable assembly transmits high frequency signals, for example, 5 GHz (gigahertz) signals or above, parallel electrical contacts with an equal distance and material of the electrical contacts may affect the signal integrity (SI) of the signals so as to reduce the signal transmitting quality and speed.

Therefore, the cable assembly 100 adjusts the center line distance of two adjacent electrical contacts 120, e.g. the first signal electrical contact 122 and the second signal electrical contact 123, and/or the third signal electrical contact 125 and the fourth signal electrical contact 126, to improve the signal integrity (SI) so as to effectively improve the signal transmitting quality and speed.

In some embodiments, the first signal electrical contact 122 and the second signal electrical contact 123, and the third signal electrical contact 125 and the fourth signal electrical contact 126 respectively includes a first center distance 310, a second center distance 320, a third center distance 330 and a fourth center distance 340.

The second center distance 320 and the third center distance 330 are reduced center distances which are smaller than the first center distance 310 and the fourth center distance 340 to improve the signal integrity (SI) and further effectively improve the signal transmitting quality and speed.

Measuring positions of the first center distance 310 are located in the exposing sections 304, and the measuring positions of the first center distance 310 are adjacent to the contact sections 302 and located between the fixing sections 306 and the contact sections 302. That is to say, the first center distance 310 is a distance between the center line 350 and the center line 360 of portions, adjacent to the contact sections 302 and located between the fixing sections 306 and the contact sections 302, of the exposing sections 304 of the first signal electrical contact 122 and the second signal electrical contact 123, or a distance between the center line 350 and the center line 360 of portions, adjacent to the contact sections 302 and located between the fixing sections 306 and the contact sections 302, of the exposing sections 304 of the third signal electrical contact 125 and the fourth signal electrical contact 126.

In addition, Measuring positions of the second center distance 320 are located at the exposing sections 304 and close to the fixing sections 306. That is to say, the second center distance 320 is a distance between the center line 350 and the center line 360 of portions, close to the fixing sections 306, of the exposing sections 304 of the first signal electrical contact 122 and the second signal electrical contact 123, or a distance between the center line 350 and the center line 360 of portions, close to the fixing sections 306, of the exposing sections 304 of the third signal electrical contact 125 and the fourth signal electrical contact 126.

It can be seen through experiment that when the second center distance 320 is smaller than the first center distance 310, the signal integrity of the signal transmission of the first signal electrical contact 122 and the second signal electrical contact 123, and the signal integrity of the signal transmission of the third signal electrical contact 125 and the fourth signal electrical contact 126 can be effectively improved, and the quality and speed of signal transmission thereof are increased.

Furthermore, the third center distance 330 is located in the fixing sections 306, that is to say, the third center distance 330 is a distance, measured in the fixing sections 306, between the center line 350 of the first signal electrical contact 122 and the center line 360 of the second signal electrical contact 123, or a distance, measured in the fixing sections 306, between the center line 350 of the third signal electrical contact 125 and the center line 360 of the fourth signal electrical contact 126.

It can be also seen through experiment that when the third center distance 330 is smaller than the first center distance 310, the signal integrity of the signal transmission of the first signal electrical contact 122 and the second signal electrical contact 123, and the signal integrity of the signal transmission of the third signal electrical contact 125 and the fourth signal electrical contact 126 can be effectively improved, and the quality and speed of signal transmission thereof are increased.

Furthermore, the fourth center distance 340 is located in the wire connection sections 308 and adjacent to the fixing sections 306, that is to say, the fourth center distance 340 is a distance, measured in the wire connection sections 308, between the center line 350 of the first signal electrical contact 122 and the center line 360 of the second signal electrical contact 123, or a distance, measured in the wire connection sections 308, between the center line 350 of the third signal electrical contact 125 and the center line 360 of the fourth signal electrical contact 126. In some embodiments, the first center distance 310 is approximately equal to the fourth center distance 340, and larger than the second center distance 320 and the third center distance 330 to improve the signal integrity of the signal transmission, and the quality and speed of signal transmission thereof are increased. In some embodiments, a center distance located at an area between the second center distance 320 and the third center distance 330 is approximately equal to the first center distance 310 to improve the signal integrity of the signal transmission, and the quality and speed of signal transmission thereof are increased.

In some embodiments, the fixation device 140 is configured to fix the electrical contacts 120 by, for example, plastic insert molding to hold and fix the fixing sections 306 of the electrical contacts 120, and further fix the electrical contacts 120 in the electrical contact fixing hole 146 of the fixation device main body 142, as well as the wires 110 are separately welded to the wire connection sections 308 of the electrical contacts 120 and a fixing protrusion 144 of the fixation device main body 142 is fixed in a fixing indentation 132 of the protecting cover 130 so that the fixation device 140, the wires 110 and the electrical contacts 120 are positioned and installed in the protecting cover 130.

The protecting cover 130 includes a protecting lid 136 and a U-shaped sidewall 134 formed on one side of the protecting lid 136 to effectively protect the electrical contacts 120 in an accommodating groove 137 and allow the electrical contacts 120 exposing on one side opposite to the protecting lid 136 of the protecting cover 130 to connect to pads on a printed circuit board.

In some embodiments, the protecting cover 130 and the fixation device 140 are a plastic protecting cover and a plastic fixation device.

In some embodiments, the protecting cover 130 further includes a positioning protrusion 138 to couple to a fixing device on a circuit board to exactly connect the electrical contacts 120 to the pads on the circuit board.

In some embodiments, the reduced center distance can be formed at any positions of the electrical contacts, for example, wire connection sections or the like. In addition, a plurality of reduced center distances can be formed in the contact sections, the exposing sections, the fixing sections or the wire connection sections of the electrical contacts without departing from the spirit and scope of the present application.

Accordingly, the cable assembly can be conveniently coupled to the print circuit board to directly connect to the pads on the print circuit board. In addition, because that the shape of the electrical contacts are changed to improve the signal integrity, the signal integrity of the high frequency signal can be effectively improved more effectively, and furthermore the quality and speed of the high frequency signal transmission are also effectively increased.

As is understood by a person skilled in the art, the foregoing preferred embodiments of the present invention are illustrative of the present invention rather than limiting of the present invention. It is intended that various modifications and similar arrangements be included within the spirit and scope of the appended claims, the scope of which should be accorded the broadest interpretation so as to encompass all such modifications and similar structures.

What is claimed is:

1. A cable assembly, comprising;

a plurality of wires;

a plurality of electrical contacts, the electrical contacts comprising contact sections, fixing sections and wire connection sections, the wire connection sections of the electrical contacts respectively connecting to the wires, wherein two adjacent electrical contacts of the electrical contacts comprise a first center distance and a reduced center distance, the first center distance adjacent to the contact sections and the reduced center distance located between the first center distance and the wire connection sections, the first center distance larger than the reduced center distance to improve a signal integrity for the cable assembly; and a fixation device to fix the electrical contacts, wherein the reduced center distance comprises a second center distance located between the fixing sections and the first center distance, and a third center distance located at the fixing sections, and the fixing sections with the third center distance are hidden in the fixation device.

2. The cable assembly of claim 1, wherein the electrical contacts are held and fixed by the fixation device through a plastic insert molding process.

3. The cable assembly of claim 1, wherein the two adjacent electrical contacts further comprise a fourth center distance located at the wire connection sections and the first center distance is equal to the fourth center distance.

4. The cable assembly of claim 1, wherein the two adjacent electrical contacts are a pair of signal transmission electrical contacts.

5. The cable assembly of claim 1, further comprising a protecting cover, wherein the fixation device fixes the electrical contacts in the protecting cover, and the protecting cover comprises a protecting lid and a U-shaped sidewall formed on one side of the protecting lid.

6. The cable assembly of claim 5, wherein the protecting cover is a plastic protecting cover and the fixation device is a plastic fixation device.

* * * * *